US006527169B2

(12) United States Patent
Kim

(10) Patent No.: US 6,527,169 B2
(45) Date of Patent: Mar. 4, 2003

(54) PAPER CUP HAVING INTEGRAL HANDLE

(76) Inventor: Yeong Leul Kim, 1-89, 1-Ka, Cheongpa-Dong, Yongsan-Ku, Seoul (KR)

( * ) Notice: Subject to any disclaimer, the term of this patent is extended or adjusted under 35 U.S.C. 154(b) by 0 days.

(21) Appl. No.: 10/097,858

(22) Filed: Mar. 15, 2002

(65) Prior Publication Data

US 2002/0148888 A1 Oct. 17, 2002

(30) Foreign Application Priority Data

Apr. 11, 2001 (KR) ..... 2001-0019352

(51) Int. Cl.[7] ..... A63H 11/12
(52) U.S. Cl. ..... 229/402; 229/117.12
(58) Field of Search ..... 229/117.12, 117.13, 229/117.22, 402, 199; 220/771

(56) References Cited

U.S. PATENT DOCUMENTS 2,060,781 A * 11/1936 Annen ..... 229/402
2,287,644 A * 6/1942 Schacht ..... 229/402
2,453,973 A * 11/1948 Coats ..... 229/117.12
2,560,927 A * 7/1951 Buttery et al. ..... 229/117.12
2,641,403 A * 6/1953 Buttery et al. ..... 229/402
2,659,527 A * 11/1953 Liebenow ..... 229/402
3,387,762 A * 6/1968 Zupon ..... 229/117.13
4,140,267 A * 2/1979 Scott et al. ..... 229/199
4,383,637 A * 5/1983 Pfieffer et al. ..... 229/117.22
4,391,366 A * 7/1983 Hirata ..... 229/402
6,116,503 A * 9/2000 Varano ..... 229/402
6,260,756 B1 * 7/2001 Mochizuki et al. ..... 229/402

* cited by examiner

*Primary Examiner*—Gary E. Elkins
(74) *Attorney, Agent, or Firm*—Jones, Tullar & Cooper, P.C.

(57) ABSTRACT

Disclosed is a paper cup having an integral handle. An extended section is integrally formed at one end of a side wall of a paper cup which one end is overlapped with the other end of the side wall to be heat-fused therewith. At least a distal end of the extended section is heat-fused to the side wall in a manner such that a remaining part of the extended section serves as a detached part which is not heat-fused to the side wall. Cut lines are formed on the detached part of the extended section to define contours of a pair of handle segments. Each cut line includes a perforated line. Folding lines are formed on each handle segment so that reinforcing are flaps are created by folding the handle segment along the folding lines. A reinforcing strip is affixed to a connecting portion of the detached part, which is located between the pair of handle segments.

3 Claims, 3 Drawing Sheets

PAPER CUP HAVING INTEGRAL HANDLE

BACKGROUND OF THE INVENTION

1. Field of the Invention

The present invention relates to a paper cup having a large capacity for accommodating an item of a large volume, such as instant noodles, etc., and more particularly, the present invention relates to a paper cup having an integral handle.

2. Description of the Related Art

In a conventional paper cup having a handle, the handle is separately formed and bonded by an adhesive to a side wall of the paper cup. This type of paper cup suffers from defects in that, since the handle should be separately formed and bonded by the adhesive to the side wall of the paper cup, a manufacturing procedure is complicated and a manufacturing cost is increased. Also, because the use of adhesive may adversely affect the human body, a commercial value of the paper cup having the handle cannot but be degraded.

SUMMARY OF THE INVENTION

Accordingly, the present invention has been made in an effort to solve the problems occurring in the related art, and an object of the present invention is to provide a paper cup having an integral handle.

In the present invention, an extended section is integrally formed at one end of a side wall of a paper cup, which one end is overlapped with the other end of the side wall to be heat-fused therewith. A distal end of the extended section is heat-fused to the side wall in a manner such that a remaining part of the extended section serves as a detached part which is not heat-fused to the side wall. Cut lines are formed on the detached part of the extended section to define contours of a pair of handle segments. Each contour of the handle segment is also delimited by a perforated line. The perforated line functions to prevent the handle segment from being spontaneously erected from the side wall toward a handle forming position while the paper cup is transported or stored in a place. A finger insertion opening is defined in each handle segment by punching out a portion of the handle segment, so that, by inserting a finger through the finger insertion opening, applying force to the handle segment and thereby separating the handle segment from the detached part along the perforated line, the handle segment can be erected toward the handle forming position. The pair of handle segments cooperatively form a handle at the handle forming position. Folding lines are formed on each handle segment so that reinforcing flaps are created by folding the handle segment along the folding lines. In addition, a reinforcing strip for reinforcing a structure surrounding the handle is affixed to a connecting portion of the detached part, which is located between the pair of handle segments.

By the features of the present invention, the paper cup having an integral handle according to the present invention can be manufactured in an easy manner. Also, by the fact that, at the same time when both ends of a side wall coated with synthetic resin to render waterproofness are heat-fused to each other, a distal end of an extended section for forming the integral handle is heat-fused to the side wall, a sanitary problem which may be caused due to the use of a separate adhesive is avoided. Further, since each handle segment is prevented from being spontaneously erected toward a handle forming position, convenience is improved upon transportation or storage of paper cups.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
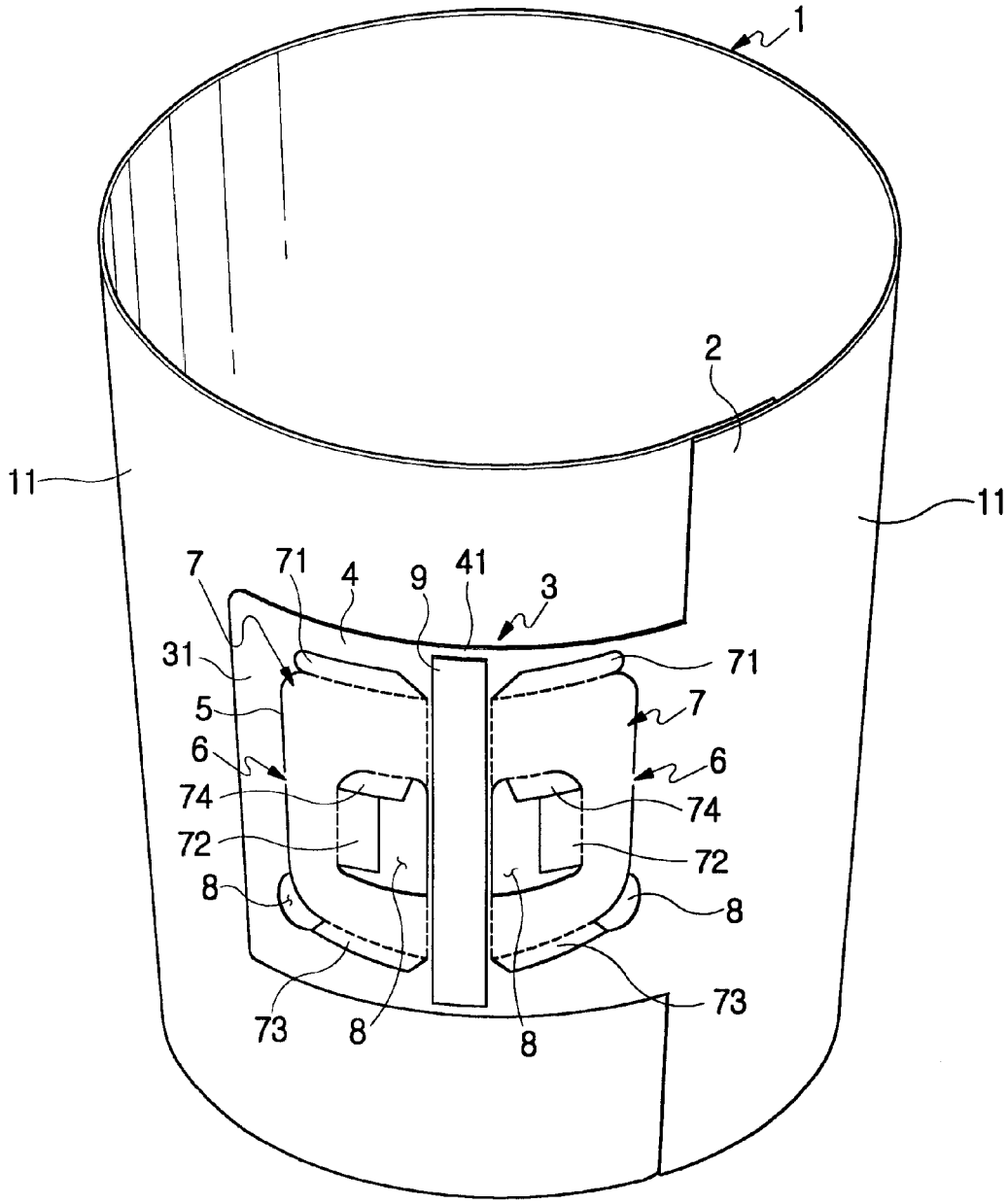
FIG. 1 is a perspective view illustrating a paper cup having an integral handle in accordance with an embodiment of the present invention.
Figure 2:
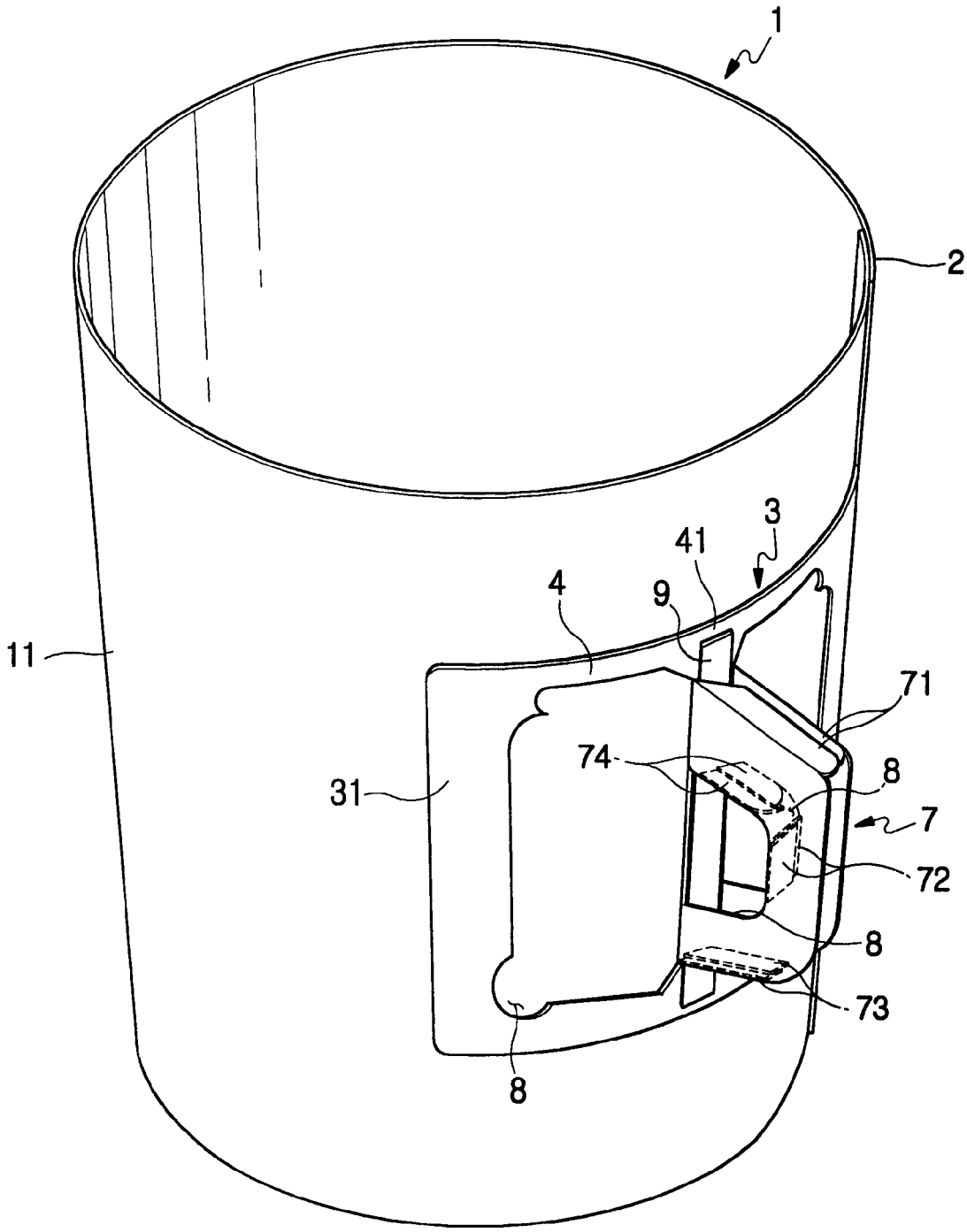
FIG. 2 is a perspective view illustrating an in-use status of the handle in the paper cup according to the present invention.
Figure 3:
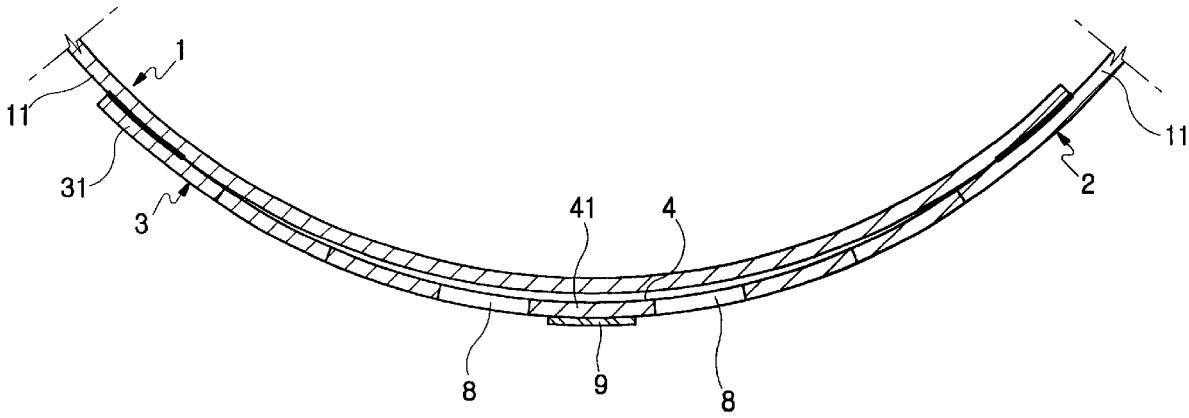
FIG. 3 is a partial transverse cross-sectional view of the paper cup shown in FIG. 1.

Reference will now be made in greater detail to a preferred embodiment of the invention, an example of which is illustrated in the accompanying drawings. Wherever possible, the same reference numerals will be used throughout the drawings and the description to refer to the same or like parts.

A paper cup 1 in accordance with an embodiment of the present invention has an extended section 3. The extended section 3 is integrally formed at one end 2 of a side wall 11 of the paper cup 1, which one end 2 is overlapped with the other end of the side wall 11 to be heat-fused therewith. A distal end 31 of the extended section 3 is heat-fused to the side wall 11 in a manner such that a remaining part of the extended section 3 serves as a detached part 4 which is not heat-fused to the side wall 11. Cut lines 5 are formed on the detached part 4 of the extended section 3 to define contours of a pair of handle segments 7. Each contour of the handle segment 7 is also delimited by a perforated line 6. The perforated line 6 functions to prevent the handle segment 7 from being spontaneously erected from the side wall 11 toward a handle forming position while the paper cup 1 is transported or stored in a place. A finger insertion opening 8 is defined in each handle segment 7 by punching out a portion of the handle segment 7, so that, by inserting a finger through the finger insertion opening 8, applying force to the handle segment 7 and thereby separating the handle segment 7 from the detached part 4 along the perforated line 6, the handle segment 7 can be erected toward the handle forming position. The pair of handle segments 7 cooperatively form a handle at the handle forming position.

While it is preferred that, as described above, only the distal end 31 of the extended section 3 is heat-fused to the side wall 11 of the paper cup 1, in the case of symmetrically forming two handle segments 7 as shown in the drawings, it can be envisaged that a connecting portion 41 of the detached part 4, which is located between the pair of handle segments 7, is also heat-fused to the side wall 11 of the paper cup 1.

Folding lines are formed on each handle segment 7 so that reinforcing flaps 71, 72, 73 and 74 are created by folding the handle segment 7 along the folding lines. Also, a reinforcing strip 9 for reinforcing a structure surrounding the handle segments 7 is affixed to the connecting portion 41 of the detached part 4. The reinforcing strip 9 can be affixed using an adhesive tape.

In the paper cup 1 according to the present invention, constructed as mentioned above, the extended section 3 for forming the handle is cut integrally with the side wall 11, and at least the distal end 31 of the extended section 3 is heat-fused to the side wall 11 upon heat-fusing both ends of the side wall 11 coated with synthetic resin to render waterproofness. Therefore, the number of processes required for manufacturing a paper cup having a handle can be considerably decreased. Also, upon forming the handle, it is not necessary to use an adhesive.

The reinforcing flaps 71, 72, 73 and 74, which are formed by folding the handle segments 7 along the folding lines, function to protect the human hand from being damaged by sharp edges of the handle segments 7 upon grasping the handle. Further, the reinforcing flaps 71 and 74 respectively formed at an upper end of each handle segment 7 and in the finger insertion opening 8 prevent the paper cup 1 from swaying leftward and rightward upon grasping the handle. The reinforcing flap 72, which is formed in the finger insertion opening 8 and extends in a longitudinal direction, prevents the handle from collapsing. The reinforcing flap 73 formed at a lower end of each handle segment 7 prevents a lower leg portion of each handle segment 7 from being crushed.

As apparent from the above description, the paper cup having an integral handle according to the present invention provides advantages in that, since a separate handle preparing procedure can be omitted and the handle is automatically formed in the course of manufacturing the paper cup, a manufacturing cost can be reduced, and a sanitary problem which may be caused due to the use of a separate adhesive is avoided.

Moreover, in the present invention, because the handle is reinforced in its strength, when the handle is grasped, the paper cup is prevented from swaying or collapsing. Furthermore, the likelihood of the human hand to be damaged by sharp edges of handle segments is eliminated by the presence of reinforcing flaps which are formed by folding the handle segments along folding lines.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A paper cup having a side wall with overlapping ends and an integral handle, wherein an extended section is integrally formed at one of said overlapped ends of said side wall of said paper cup, said overlapped ends being heat-fused together, and further wherein at least a distal end of said extended section is heat-fused to said side wall in a manner such that a remaining part of said extended section serves as a detached part which is not heat-fused to said side wall, cut lines are formed on said detached part of said extended section to define contours of a pair of handle segments, and folding lines are formed on each handle segment so that reinforcing flaps are created by folding said handle segment along the fold lines.

2. The paper cup as set forth in claim 1, wherein each cut line includes a perforated line.

3. The paper cup as set forth in claim 1, wherein a reinforcing strip located between said pair of handle segments is affixed to a connecting portion of the detached part.

* * * * *